US008519896B2

(12) United States Patent
Onaka et al.

(10) Patent No.: US 8,519,896 B2
(45) Date of Patent: Aug. 27, 2013

(54) ANTENNA HAVING LINE-SHAPED ELECTRODE ON BOARD END SURFACE

(75) Inventors: Kengo Onaka, Kanagawa-ken (JP); Takashi Ishihara, Tokyo-to (JP)

(73) Assignee: Murata Manufacturing Co., Ltd. (JP)

( * ) Notice: Subject to any disclaimer, the term of this patent is extended or adjusted under 35 U.S.C. 154(b) by 444 days.

(21) Appl. No.: 12/911,542

(22) Filed: Oct. 25, 2010

(65) Prior Publication Data

US 2011/0109510 A1 May 12, 2011

(30) Foreign Application Priority Data

Nov. 6, 2009 (JP) ..... 2009-254970

(51) Int. Cl.
*H01Q 1/24* (2006.01)

(52) U.S. Cl.
USPC ..... 343/702; 343/700 MS

(58) Field of Classification Search
USPC ..... 343/702, 700 MS, 846
See application file for complete search history.

(56) References Cited

U.S. PATENT DOCUMENTS

| | | | | |
|---|---|---|---|---|
| 6,700,543 | B2 * | 3/2004 | Konishi et al. | 343/700 MS |
| 7,786,940 | B2 * | 8/2010 | Hirano | 343/702 |
| 2007/0188383 | A1 | 8/2007 | Onaka et al. | |
| 2009/0040120 | A1 * | 2/2009 | Tsubaki et al. | 343/702 |
| 2009/0295653 | A1 * | 12/2009 | Komura | 343/702 |

FOREIGN PATENT DOCUMENTS

| | | | |
|---|---|---|---|
| CN | 101341630 | A | 1/2009 |
| CN | 101395758 | A | 3/2009 |
| JP | 2001-24416 | A | 1/2001 |
| JP | 2002-299933 | A | 10/2002 |
| JP | 2004-129234 | | 4/2004 |
| JP | 2006-74446 | A | 3/2006 |
| JP | 4129803 | | 8/2008 |
| JP | 2009-171096 | | 7/2009 |
| WO | 2005/107010 | A1 | 11/2005 |
| WO | 2007/043150 | A1 | 4/2007 |

OTHER PUBLICATIONS

Japanese Office Action "Notification of Reason for Rejection" dated Mar. 6, 2012; Japanese Patent Application No. 2009-254970 with translation.

The Office Action issued from State Intellectual Property Office of People's Republic of China dated Apr. 3, 2013, which corresponds to Chinese Patent Application No. 201010535073.2 and is related to U.S. Appl. No. 12/911,542 with translation.

* cited by examiner

*Primary Examiner* — Hoanganh Le
(74) *Attorney, Agent, or Firm* — Studebaker & Brackett PC

(57) ABSTRACT

An antenna includes a board having a substrate and a ground electrode, electrodes provided on external surfaces of the substrate, a feeding element provided near an end surface of the board. The feeding element includes an electrically insulating base member and a feeding radiation electrode provided on the base member. A non-feeding element including a substantially line-shaped electrode is provided on the board and includes at least one end thereof connected to the ground electrode and electromagnetically coupled with the feeding element. At least part of the substantially line-shaped electrodes is provided on the end surface of the board.

11 Claims, 7 Drawing Sheets

ANTENNA HAVING LINE-SHAPED ELECTRODE ON BOARD END SURFACE

CROSS REFERENCE TO RELATED APPLICATIONS

The present application claims priority to Japanese Patent Application No. 2009-254970 filed Nov. 6, 2009, the entire contents of which is incorporated herein by reference in its entirety.

FIELD OF THE INVENTION

The present invention relates to antennas which produce multiple resonances.

BACKGROUND

Configurations of antennas producing multiple resonances are disclosed in the following patent documents.

For example, Japanese Patent No. 4129803 discloses an antenna having a radiation electrode (non-feeding element) which projects outside a ground area of a mounting board. In the antenna, non-feeding elements are formed using radiation electrodes on the top and bottom surfaces of the mounting board or using an independent radiation electrode.

Japanese Unexamined Patent Application Publication No. 2004-129234 discloses an antenna having a radiation electrode that extends along an edge of a mounting board.

Japanese Unexamined Patent Application Publication No. 2009-171096 discloses an antenna in which a feeding element and a non-feeding element are arranged in parallel.

In addition, PCT International Publication No. WO2007-043150 discloses an antenna having a feeding element provided on a rear surface of a casing and a non-feeding element provided on a side surface of the casing.

FIG. 1 illustrates an example of an antenna disclosed in Japanese Unexamined Patent Application Publication No. 2004-129234. A ground plate 21 is a conductive circuit board. A feeding point 22 is provided on a side edge of a ground plate 21 to feed power to an antenna element 23 connected to the feeding point 22. The electrical length of the antenna element 23 is approximately ⅜ wavelength of the operation frequency band. The antenna element extends from the feeding point 22 along an edge portion of the ground plate 21 within the thickness of the ground plate 21 and is short-circuited to the other side edge of the ground plate 21.

However, the antenna configurations described above have problems in measuring antenna performance in terms of efficiency, band width, and in improving the antenna performance.

In the antenna disclosed in Japanese Patent No. 4129803, the area of the second non-feeding radiation element is increased to improve antenna efficiency. The antenna has a structural limitation in that it is necessary to enlarge the mounting board to the outside or prepare an independent element in order to expand the area of the second non-feeding radiation element.

To improve the efficiency of the antenna disclosed in Japanese Unexamined Patent Application Publication No. 2004-129234, it is also necessary to enlarge the mounting board or prepare an independent radiation element, and such an arrangement is subject to a structural limitation.

To improve the efficiency of the antenna disclosed in Japanese Unexamined Patent Application Publication No. 2009-171096, it is necessary to increase the height of the antenna. In addition, a decrease in the width of the antenna (direction along which the feeding element and the non-feeding element are arranged) decreases the width of the radiation electrodes, which increases the probability of loss.

In the antenna disclosed in PCT International Publication No. WO2007-043150, a radiation electrode is arranged on a casing surface. Thus, when the radiation electrode is composed of a flexible substrate, copper foil or the like, the radiation electrode may become detached from the casing, and deviations and variations of attachment position may occur. As a countermeasure, a spring contact may be used to feed power. However, such an arrangement complicates the antenna structure.

SUMMARY

An antenna according to an embodiment consistent with the claimed invention includes a board including a ground electrode, a feeding element having a an electrically insulating base member provided near one end surface of the board and on which a feeding radiation electrode is formed, and a non-feeding element composed of a substantially line-shaped electrode which is provided on the board. The substantially line-shaped electrode has at least one end of connected to a ground electrode of the board and is coupled with the feeding element.

According to a more specific exemplary embodiment, the board may be one of plural boards on a motherboard, and the board may be separated from the motherboard. Additionally, the substantially line-shaped electrode may be a conductor provided on an inner surface of a slit or a hole provided between the board and an adjacent board on the motherboard, or between the board and an adjacent supporting frame.

In another more specific exemplary embodiment, the substantially line-shaped electrode may be fabricated by a process used to fabricate a plated through hole.

Another more specific exemplary embodiment may include a chip reactance element connected between the ground electrode and the non-feeding element provided on the board.

In another more specific exemplary embodiment, the board may be composed of one of a dielectric material, a magnetic material, and a mixture of a dielectric material and a magnetic material.

In another more specific exemplary embodiment, the substantially line-shaped electrode may include at least a first segment having the one end connected to the ground electrode and a second segment including the part on the end surface of the board, and the first and second segments are electrically connected to each other.

In another more specific exemplary embodiment, the feeding element may be near a second end of the board, the first segment may extend from the ground electrode to the second segment, and the first segment may be positioned adjacent to the second end of the board.

In yet another more specific embodiment, the first and second segments of the substantially line-shaped electrode may be substantially parallel with respective segments of the feeding radiation electrode.

In another more specific embodiment, the substantially line-shaped electrode may include an open-circuited end.

Other features, elements, characteristics and advantages of the present invention will become more apparent from the following detailed description of preferred embodiments of the present invention with reference to the attached drawings.

DETAILED DESCRIPTION

Referring to FIG. 2 to FIG. 5, an antenna and a mobile wireless communication device according to the first exemplary embodiment will be described.

Figure 1:
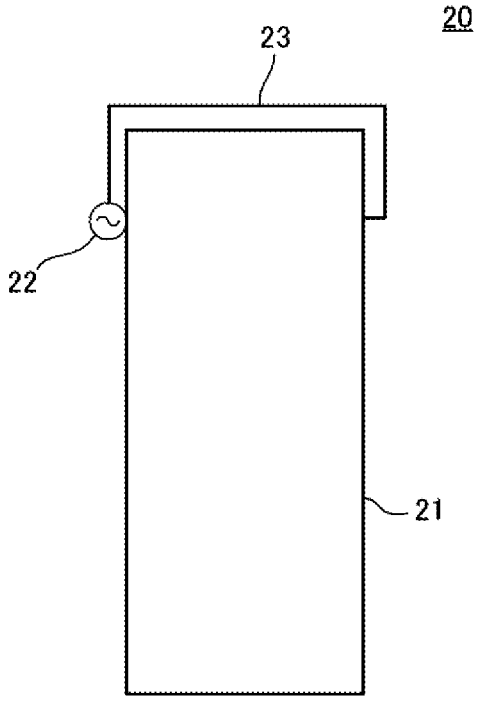
FIG. 1 Prior Art
FIG. 1 illustrates an example of a configuration of an antenna according to the related art.
Figure 2:
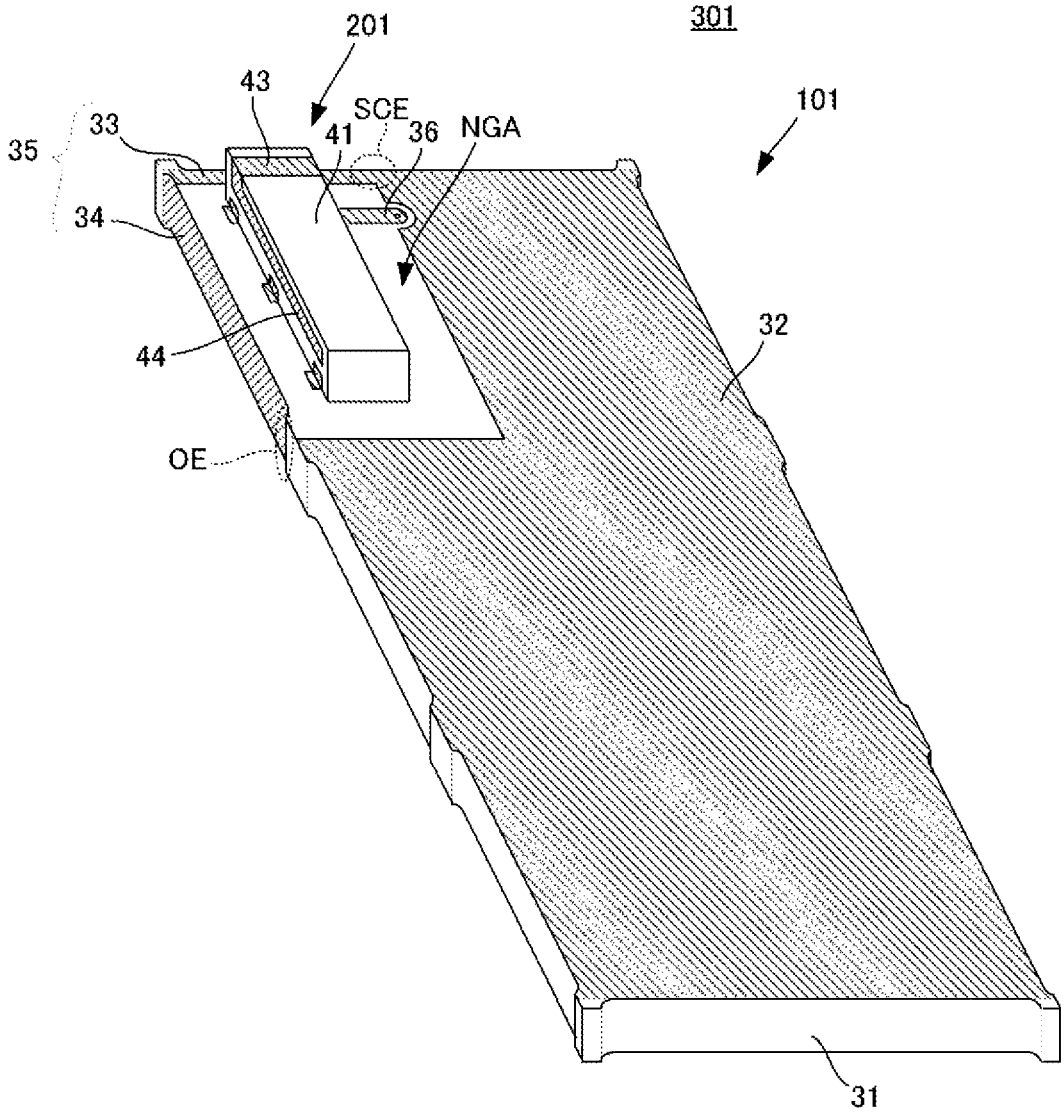
FIG. 2 is a perspective view of an antenna according to a first exemplary embodiment.

FIG. 2 is a perspective view of an antenna 301 according to the first exemplary embodiment. The antenna 301 has a board 101 and a feeding element 201 mounted on the board 101. The board 101 includes a substrate 31 and electrodes provided on an external surface of the substrate 31. The feeding element 201 includes a base member 41 formed of an electrically insulating material, for example a dielectric material, and electrodes provided on external surfaces of the dielectric base member 41.

A ground electrode 32 is provided on the top surface of the substrate 31. A non-ground region NGA where no ground electrode is formed is also provided on the top surface of the substrate 31. A feeding electrode 36 is disposed or provided in the non-ground region NGA.

A substantially line-shaped electrode 33 is disposed or provided on the top surface of the substrate 31 at a position near a first end surface (rear surface not shown in FIG. 2). A first end of the substantially line-shaped electrode 33 is connected to the ground electrode 32 through a ground terminal SCE. The substantially line-shaped electrode 33 has a second end which extends to a second end surface (left side surface shown in FIG. 2) adjacent the first end surface of the substrate 31.

A substantially line-shaped electrode 34 is provided on the second end surface of the substrate 31. A first end of the substantially line-shaped electrode 34 is open-circuited at an open end OE. A second end of the substantially line-shaped electrode 34 is connected to the second end of the substantially line-shaped electrode 33.

In this way, the substantially line-shaped electrode 33 and the substantially line-shaped electrode 34 form a non-feeding element 35 in which one end is connected to the ground through the ground terminal SCE and the other end is open-circuited at the open terminal OE.

Figure 3:
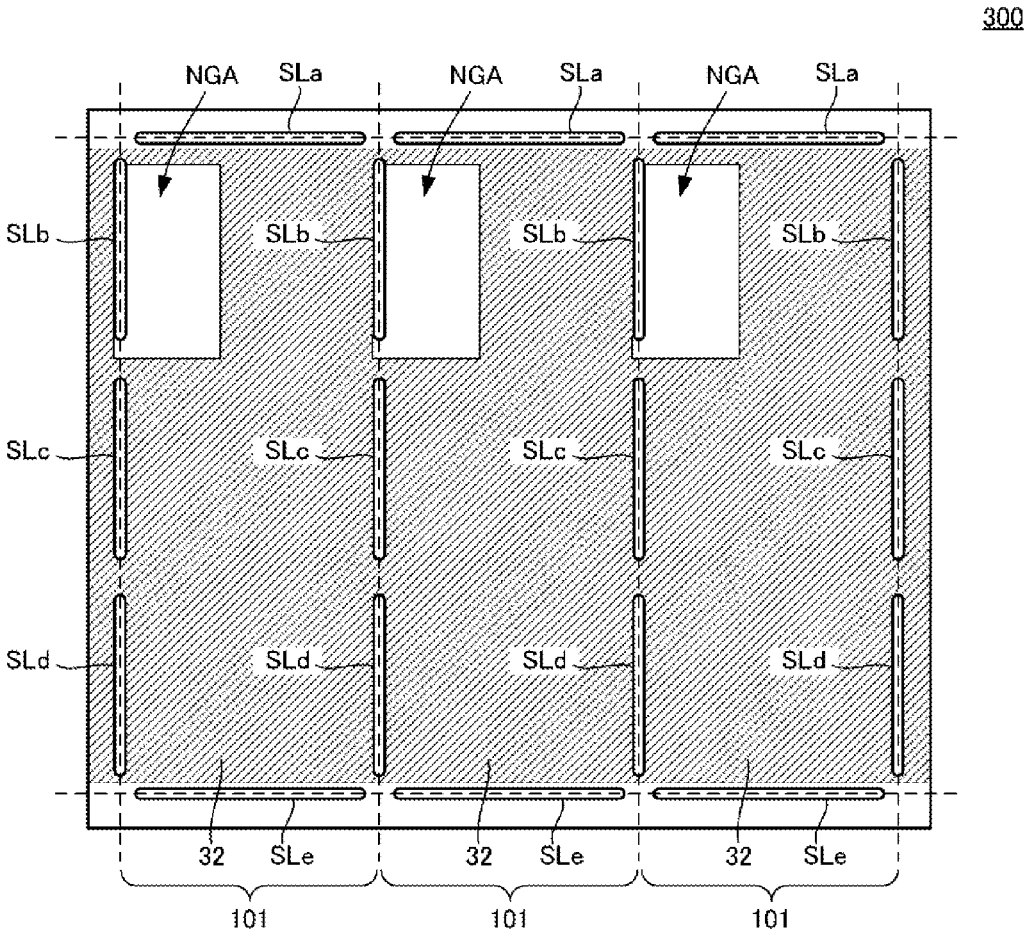
FIG. 3 is a plan view illustrating an exemplary fabrication process of a board.

FIG. 3 is a plan view illustrating a fabrication process of the board 101. The board 101 is one of partitioned components arranged on a single motherboard 300 illustrated in FIG. 3 and is to be separated from the motherboard 300. Partition lines are indicated by the broken lines in FIG. 3. Slits SLa, SLb, SLc, SLd, and SLe are formed on the motherboard 300 at positions through which the partition lines pass, and those positions are adjacent to the non-ground region NGA. A conductor film is formed on the inner surface of the slit SLb. This conductor film can be fabricated by the same processes as used to fabricate plated through holes.

Thus, the motherboard 300 is separated at the lines passing through the slits having the conductor film into a plurality of boards and supporting frames. Consequently, the conductor film on the inner surface of the slit SLb serves as the substantially line-shaped electrode 34.

Note that the ground electrode 32 can be formed over the entire surface of the board except for the non-ground region NGA. However, to prevent formation of "burrs" of the electrode film at the cutting edge, the ground electrode pattern in some embodiments can be created so that the ground electrode does not extend over the partition lines.

In the example illustrated in FIG. 3, corner portions of each board project due to adjacent ends of the slits. However, the slits can be made to extend to the corners of the substrate so that the corner portions do not project. Alternatively holes can be formed to prevent the corner portions from projecting.

Figure 4:
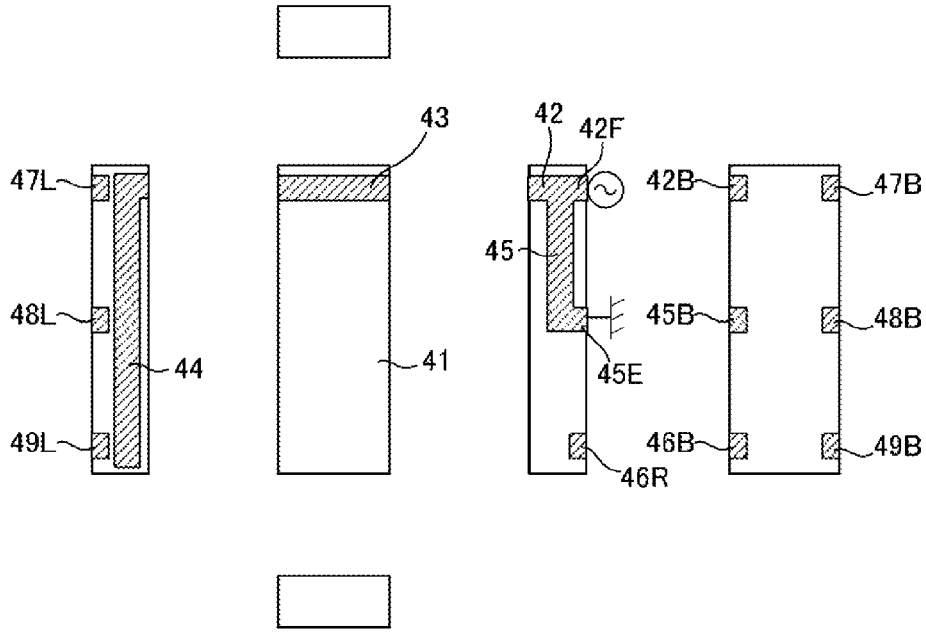
FIG. 4 shows plan views illustrating the six faces of a feeding element shown in FIG. 2.

FIG. 4 shows plan views illustrating the six faces of the non-feeding element 201. A feeding radiation electrode 43 is provided on the top surface of the dielectric base member 41. A feeding radiation electrode 44 and terminal electrodes 47L, 48L, and 49L are disposed or provided on the left side surface of the dielectric base member 41. Feeding radiation electrodes 42 and 45 and a terminal electrode 46R are formed on the right side surface of the dielectric base member 41.

Terminal electrodes 42B, 45B, 46B, 47B, 48B, and 49B are formed on the bottom surface of the dielectric base member 41.

The feeding radiation electrodes 42, 43, and 44 are consecutively connected. One end of the feeding radiation electrode 42 (the end connected to the bottom surface of the dielectric base member 41) is connected to the terminal electrode 42B on the bottom surface. The terminal electrode 42B serves as a feeding point. One end of the feeding radiation electrode 44 (the end by the front surface of the dielectric base member 41) is an open end.

A first end of the feeding radiation electrode 45 is connected to a part of the feeding radiation electrode 42 and a second end 45E is electrically connected to the terminal electrode 45B. The terminal electrode 45B serves as a ground terminal.

The terminal electrodes 47L, 48L, and 49L are connected to the terminal electrodes 47B, 48B, and 49B, respectively, on the bottom surface. These terminal electrodes do not particularly affect the electrical characteristics of the antenna and are simply used for mounting the feeding element 201.

The configuration of feeding element 201 described above allows the feeding radiation electrodes 42, 43, and 44 to function as radiation electrodes of a so-called inverted F antenna.

Note that the dielectric base member 41 can be composed of a magnetic material.

Figure 5:
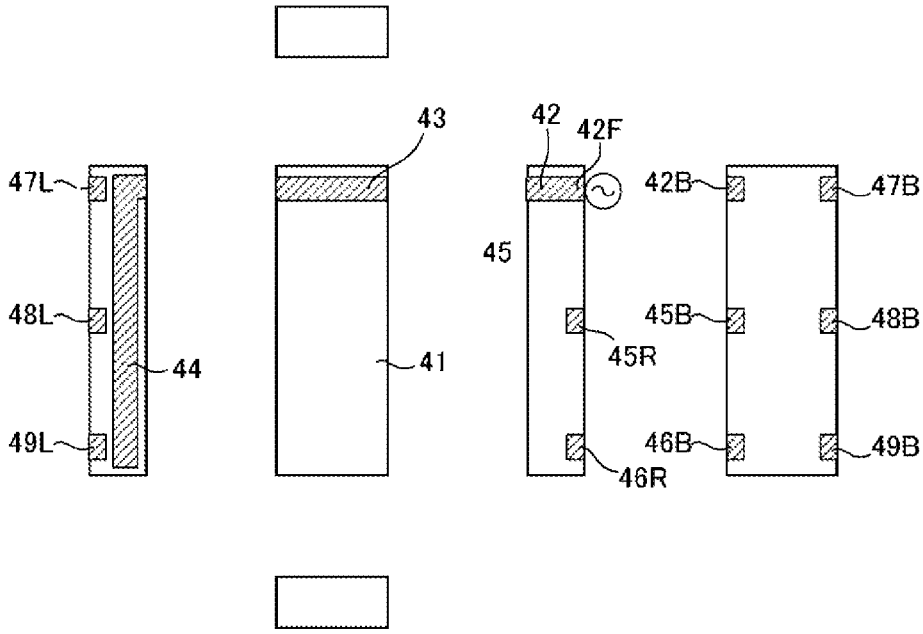
FIG. 5 shows plan views illustrating the six faces of the feeding element having another exemplary configuration.

FIG. 5 shows plan views illustrating the six faces of the feeding element 201 having another exemplary configuration. The feeding element 201 in FIG. 5 is different from the feeding element 201 in FIG. 4 in that it does not have the feeding radiation electrode 45 on the right side surface of the dielectric base member 41 and has a terminal electrode 45R on the right surface of the dielectric base member 41. This terminal electrode 45R is connected to the terminal electrode 45B on the bottom surface. The configurations of other components are the same as those in FIG. 4.

This configuration of the feeding element 201 allows the feeding radiation electrodes 42, 43, and 44 to function as radiation electrodes of a so-called inverted L antenna.

The terminal electrode to be connected to the terminal electrodes 45B, 46B, 48B, and 49B illustrated in FIG. 4 are provided in the non-ground region NGA illustrated in FIG. 2. The terminal electrode 42B of the feeding element 201 is connected to the feeding electrode 36 when the feeding element 201 is mounted on the board 101.

When the feeding element 201 is mounted on the board 101 and a portion that extends a predetermined distance from the ground terminal SCE of the substantially line-shaped electrode 33 and the feeding radiation electrode 43 of the feeding element 201 face each other, the non-feeding element 35 and the feeding element 201 are electromagnetically coupled.

Note that it is also possible that a matching circuit is provided between the terminal electrode 45B and the ground as necessary.

The coupling between the feeding radiation electrode 43 on the feeding element 201 and the non-feeding element 35 on the board 101 produces multiple resonances and increases radiation resistance. This, as a result, increases antenna band width and improves antenna efficiency.

The antenna 301 illustrated in FIG. 2 can be accommodated in a casing of a mobile wireless communication device such as a mobile phone terminal. Other circuits including a communication circuit of the mobile wireless communication device can be arranged on the board 101.

Figure 6:
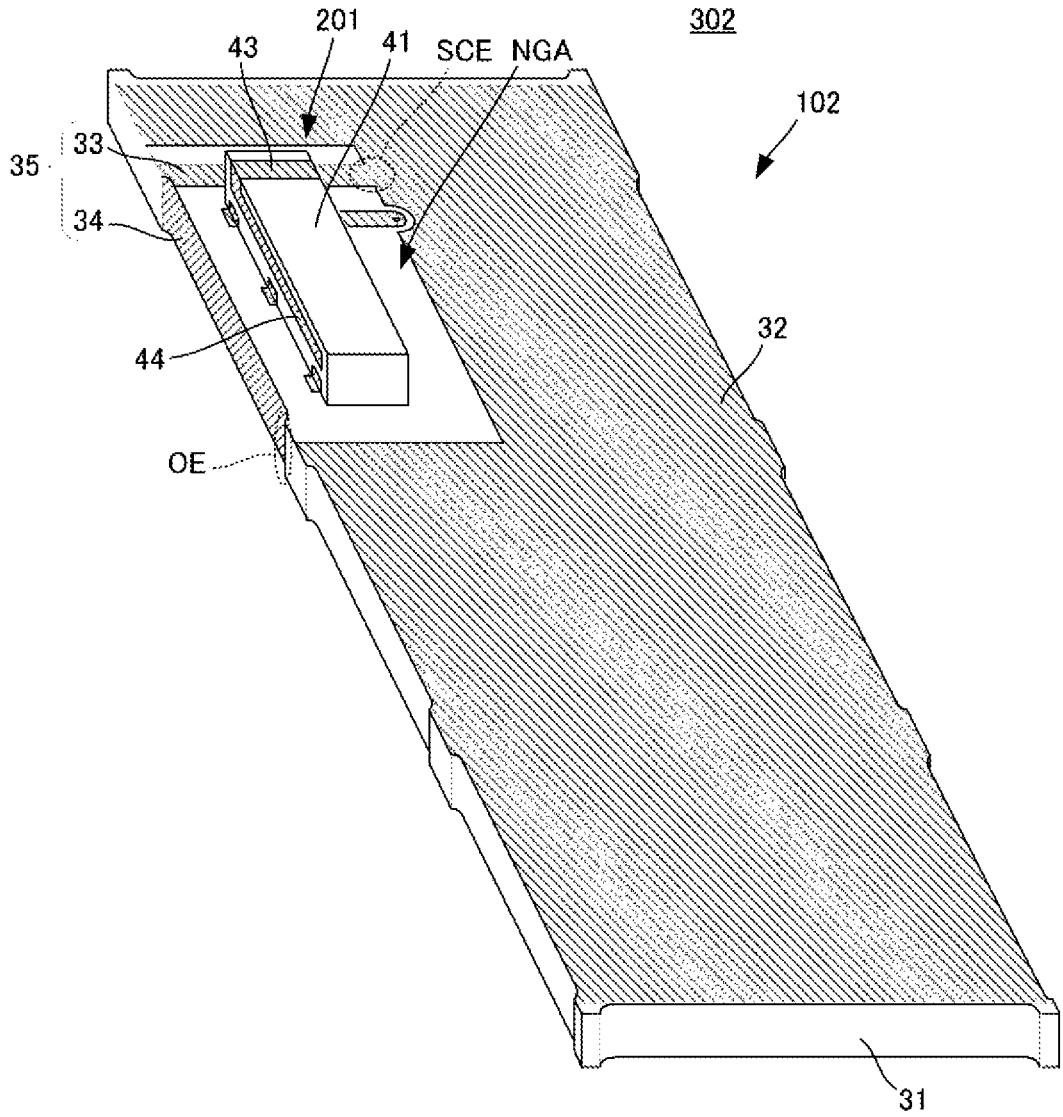
FIG. 6 is a perspective view illustrating an antenna according to a second exemplary embodiment.

FIG. 6 is a perspective view illustrating an antenna 302 according to a second embodiment. The antenna 302 has a board 102 and a feeding element 201 mounted on the board 102. The board 102 includes a substrate 31 and electrodes provided on external surfaces of the substrate 31. The feeding element 201 includes a dielectric base member 41 and electrodes provided on external surfaces of the dielectric base member 41.

The antenna 302 is different from the antenna according to the first embodiment in that a substantially line-shaped electrode 33 is arranged not at a position close to a first surface (rear surface not shown in FIG. 6) of the substrate 31 but at a position inward from the first end surface. Thus, the substantially line-shaped electrode 33 is provided within a non-ground region NGA. The other components of the antenna 102 are configured similarly to those in the first embodiment.

In this way, the board 102 having a non-ground region contacted with only a single edge of the substrate 31 can also be used.

Figure 7:
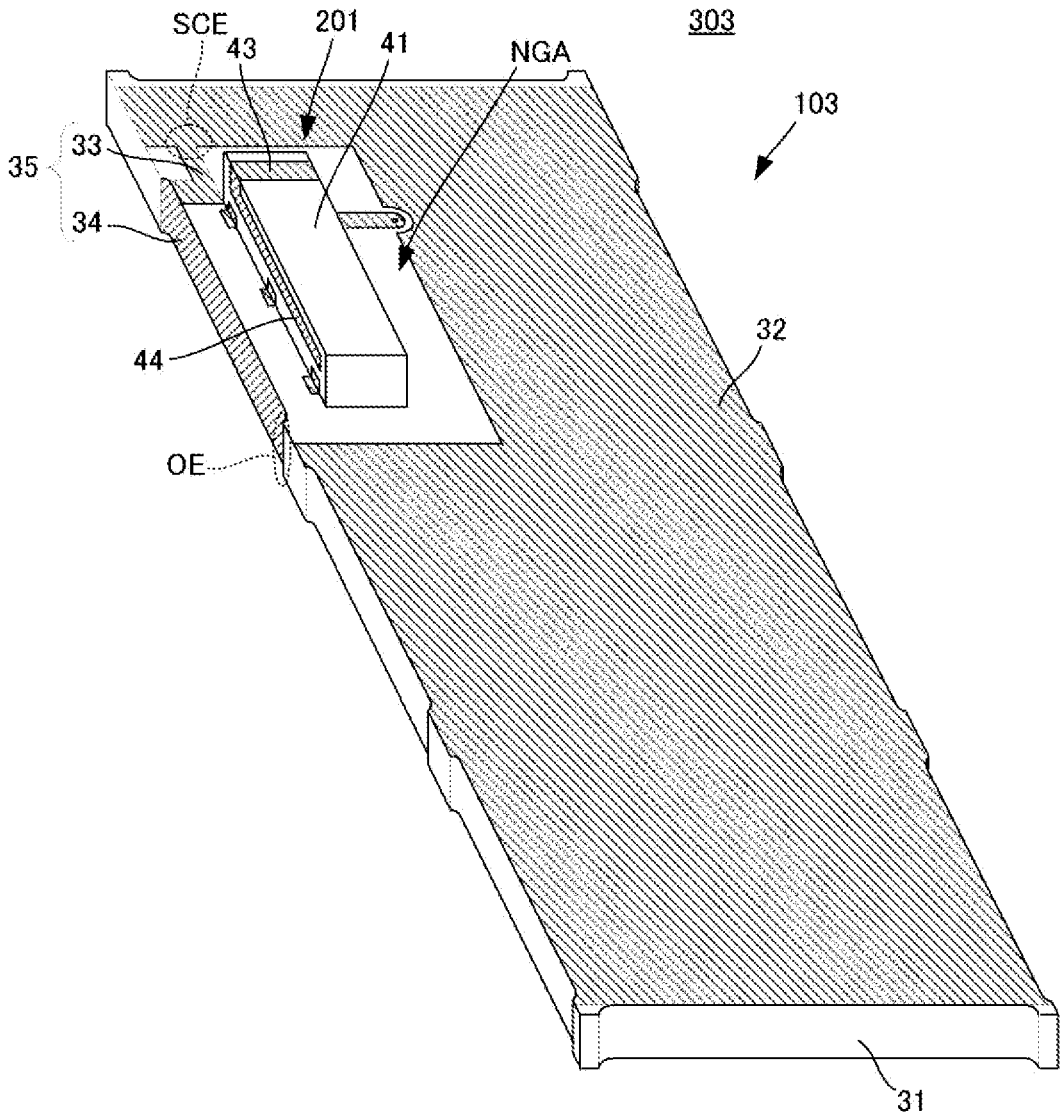
FIG. 7 is a perspective view illustrating an antenna according to a third exemplary embodiment.

FIG. 7 is a perspective view illustrating an antenna 303 according to a third exemplary embodiment. The antenna 303 has a board 103 and a feeding element 201 mounted on the board 103. The board 103 includes a substrate 31 and electrodes provided on external surfaces of the substrate 31. The feeding element 201 includes a dielectric base member 41 and electrodes provided on external surfaces of the dielectric base member 41.

The antenna 303 is different from the antennas according to the first and second exemplary embodiments in that it has a substantially line-shaped electrode 33 which does not extend below the feeding element 201 but extends in the vicinity of the feeding element 201. The other components of the antenna 303 are configured similarly to those in the first exemplary embodiment.

A portion extending a predetermined distance from a ground terminal SCE of the substantially line-shaped electrode 33 is provided or disposed adjacent a portion extending a predetermined distance from a feeding point of a feeding radiation electrode 44 of the feeding element 201. As a result, the non-feeding element 35 and the feeding element 201 are electromagnetically coupled.

As described above, the feeding element 201 can also be arranged at a position so as not cover the substantially line-shaped electrode on the board.

Figure 8:
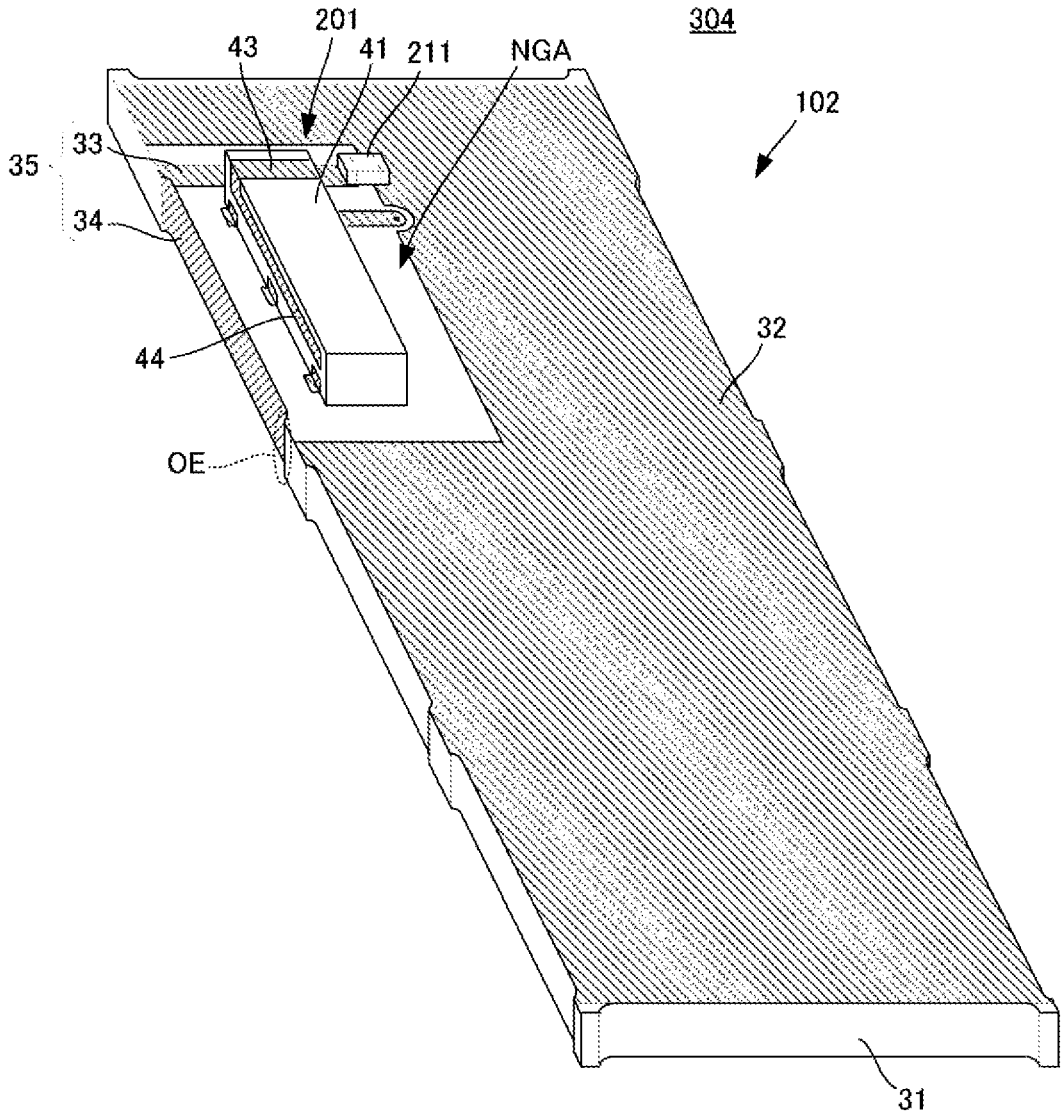
FIG. 8 is a perspective view illustrating an antenna according to a fourth exemplary embodiment.

FIG. 8 is a perspective view illustrating an antenna 304 according to a fourth exemplary embodiment. The antenna 304 has a board 102, a feeding element 201 mounted on the board 102, and a chip reactance element 211.

The antenna 304 is different from the antenna according to the second exemplary embodiment in that a first end of a substantially line-shaped electrode 33 is not connected to a ground electrode 32 and in that the chip reactance element 211 is connected between the first end of the substantially line-shaped electrode 33 and the ground electrode 32. The other components are configured similarly to those in the second exemplary embodiment.

The chip reactance element 211 can be a chip inductor. Thus, a first end of a non-feeding element 35 is to be connected to the ground via the chip reactance element 211. The reactance produced by the chip reactance element 211 permits adjustment of reactance and setting of equivalent electrical length of the non-feeding element 35. Thus, antennas having different characteristics can readily be fabricated depending on the selection of the chip reactance element 211.

In each of the embodiments described above, the feeding element 201 is mounted on the non-ground region NGA. However, the feeding element 201 can be mounted on the ground region of the board as long as the feeding element and a substantially line-shaped electrode are arranged so that a feeding radiation electrode of the feeding element can be coupled to the substantially line-shaped electrode (non-feeding element) on the board.

In each of the exemplary embodiments described above, surface mount antennas are illustrated as feeding elements. However, a sheet-metal antenna, a film antenna, or the like which can be mounted on a casing of an electronic device can be used as the feeding element.

Moreover, in each of the above exemplary embodiments, the feeding element 201 has a base member composed of a dielectric material. However, the base member can be composed of a magnetic material or a mixture of a dielectric material and a magnetic material.

Further, in each of the above exemplary embodiments, a substantially line-shaped electrode is formed on an end surface of a board by forming a conductor film on an inner surface of a slit. However, a cylindrical hole can be used instead of a slit. Alternatively, a combination of a slit and a hole can be used to form a substantially line-shaped electrode.

Embodiments consistent with the claimed invention can facilitate providing an antenna having a wide band width and high antenna efficiency. Additionally, a mobile wireless communication device having the antenna can be realized without increasing the size of a board.

While preferred embodiments of the invention have been described above, it is to be understood that these are exemplary and that variations and modifications will be apparent to those skilled in the art without departing from the scope and spirit of the invention. The scope of the invention, therefore, is to be determined solely by the following claims and their equivalents.

What is claimed is:

1. An antenna comprising:

a board including first and second major surfaces, an end surface connecting the first and second major surfaces, a ground electrode on one of the first and second major surfaces, and a non-ground region where no ground electrode is provided on said one of the first and second major surfaces;

a feeding element provided in the non-ground region near the end surface of the board, said feeding element having an electrically insulating base member on which a feeding radiation electrode is provided; and a non-feeding element composed of a substantially line-shaped electrode provided on the board, said substantially line-shaped electrode having at least one end connected to the ground electrode of the board and being coupled with the feeding element, wherein at least a part of the substantially line-shaped electrode is provided on the end surface of the board, and the substantially line-shaped electrode and the ground electrode surround a substantially entire circumference of the non-ground region.

2. The antenna of claim 1, wherein the board is one of plural boards on a motherboard and is separated from the motherboard, and wherein the substantially line-shaped electrode is a conductor provided on an inner surface of a slit or a hole provided between the board and an adjacent board on the motherboard, or between the board and an adjacent supporting frame.

3. The antenna of claim 2, wherein the substantially line-shaped electrode is fabricated by a process used to fabricate a plated through hole.

4. The antenna of claim 1, wherein a chip reactance element is connected between the ground electrode and the non-feeding element provided on the board.

5. The antenna of claim 2, wherein a chip reactance element is connected between the ground electrode and the non-feeding element provided on the board.

6. The antenna of claim 3, wherein a chip reactance element is connected between the ground electrode and the non-feeding element provided on the board.

7. The antenna of claim 1, wherein the base member includes one of a dielectric material, a magnetic material, and a mixture of a dielectric material and a magnetic material.

8. The antenna of claim 1, wherein the substantially line-shaped electrode includes at least a first segment having the one end connected to the ground electrode and a second segment including the part on the end surface of the board, said first and second segments electrically connected to each other.

9. The antenna of claim 8, wherein the feeding element is near an end of the board, and said first segment extends from the ground electrode to the second segment and is positioned adjacent to the end of the board.

10. The antenna of claim 8, wherein the feeding radiation electrode includes first and second segments and the first and second segments of the substantially line-shaped electrode are substantially parallel with the first and second segments of the feeding radiation electrode, respectively.

11. The antenna of claim 1, wherein the substantially line-shaped electrode includes an open-circuited end.

* * * * *